US012594485B2

(12) United States Patent
Park

(10) Patent No.: US 12,594,485 B2
(45) Date of Patent: Apr. 7, 2026

(54) VERMIN-RESISTANT BOCCE COURT

(71) Applicant: Philip Park, Alamo, CA (US)

(72) Inventor: Philip Park, Alamo, CA (US)

( * ) Notice: Subject to any disclaimer, the term of this patent is extended or adjusted under 35 U.S.C. 154(b) by 401 days.

(21) Appl. No.: 18/363,594

(22) Filed: Aug. 1, 2023

(65) Prior Publication Data

US 2025/0041705 A1 Feb. 6, 2025

(51) Int. Cl.

| | |
|---|---|
| ***A63D 1/04*** | (2006.01) |
| ***E01C 13/02*** | (2006.01) |
| ***E01C 13/04*** | (2006.01) |
| ***E01C 13/06*** | (2006.01) |

(52) U.S. Cl.

CPC ..... *A63D 1/04* (2013.01); *E01C 13/02* (2013.01); *E01C 13/04* (2013.01); *E01C 13/06* (2013.01)

(58) Field of Classification Search

CPC ..... A63D 1/04
USPC ..... 472/92
See application file for complete search history.

(56) References Cited

U.S. PATENT DOCUMENTS

| | | | | |
|---|---|---|---|---|
| 1,484,514 | A * | 2/1924 | Gardiner | E01C 13/04 472/92 |
| 4,515,839 | A * | 5/1985 | Broaddus | E01C 13/08 428/17 |
| 9,174,112 | B1 * | 11/2015 | Park | A63C 19/00 |
| 9,539,490 | B2 | 1/2017 | Park | |
| 2003/0092531 | A1 * | 5/2003 | Daluise | A63C 19/04 472/92 |
| 2016/0339330 | A1 * | 11/2016 | Park | A63D 1/04 |
| 2021/0238810 | A1 * | 8/2021 | Sawyer | E01C 13/08 |
| 2023/0279618 | A1 * | 9/2023 | Nicholls | A63C 19/065 73/379.04 |

* cited by examiner

*Primary Examiner* — Travis R Hunnings
(74) *Attorney, Agent, or Firm* — Gerald T. Gray; Leydig, Voit & Mayer, LTD.

(57) ABSTRACT

A low-maintenance bocce court surface comprising a concrete slab layer including an integrated drainage system with drain inlets, a modular suspended surface layer disposed over the concrete slab layer, a filter fabric layer disposed over the modular suspended surface layer, and a surface layer disposed over the filter fabric layer, wherein the drainage system is configured to drain water collected in the modular suspended surface layer to a location external to the bocce court, and a method of manufacturing the bocce ball court.

20 Claims, 1 Drawing Sheet

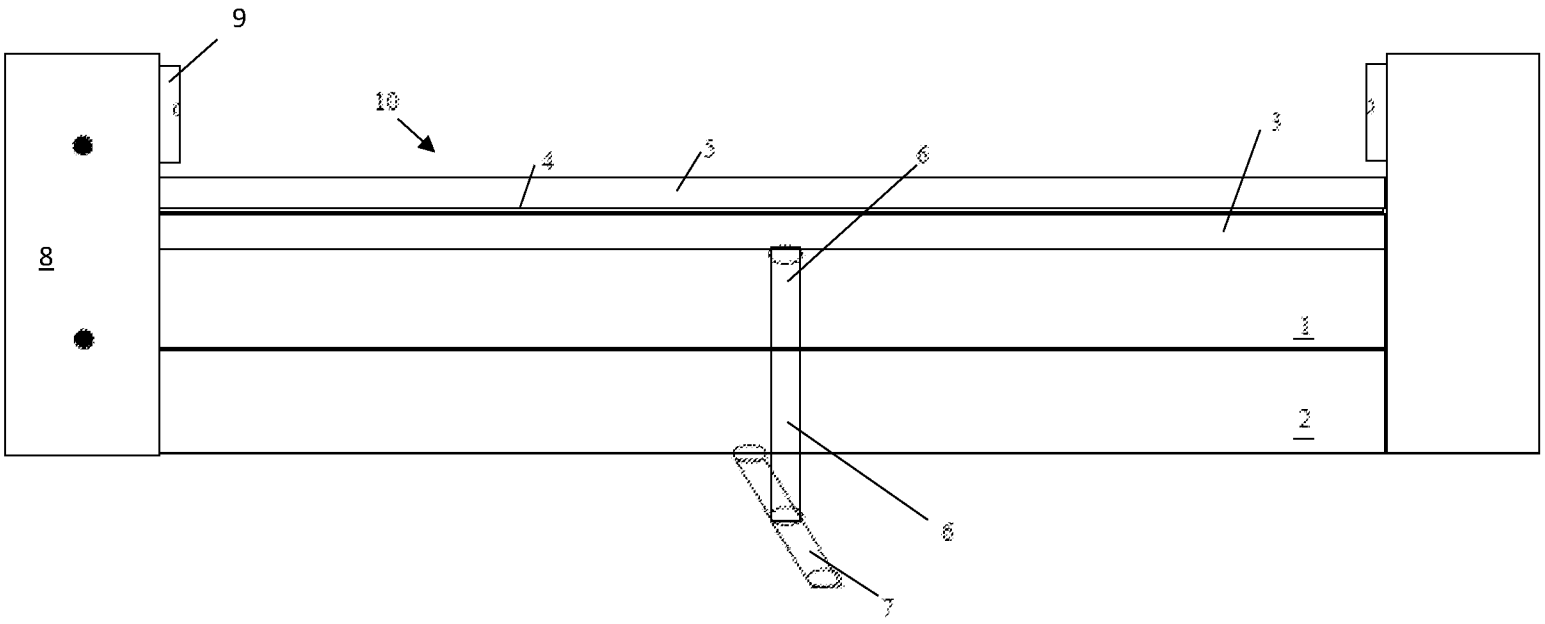
9
10
4
3
6
3
3
2
6
7
8

VERMIN-RESISTANT BOCCE COURT

BACKGROUND

Bocce is traditionally played on courts of clay, sometimes with sand or crushed oyster shells as a surface layer. These traditional bocce courts require constant maintenance and proper hydration to remain playable. Frequent raking, rolling and hydrating is needed to keep the playing surface level and smooth, and to remove grooves and indentations left from previous rounds of play. The rigorous maintenance requirements of traditional bocce courts have led others to employ synthetic materials, particularly artificial grass, as a surface for bocce courts. Conventional synthetic surfaces, however, do not provide the proper ball bounce, rolling speed and resistance, or other characteristics of traditional bocce courts.

Moreover, vermin such as underground moles, voles and gophers and other tunneling animals pose a problem to the planarity of the court. A problem with existing bocce surfaces is that these animals burrow under the court causing materials in the court to settle and drop which leads to an uneven playing surface. A complete removal and replacement of the surface materials may be needed. Mitigating the burrowing animal problem itself is often ineffective and may still result in a very expensive repair that might need to be repeated over and over with no conclusive result. Thus, there remains a need for improved low-maintenance bocce courts.

BRIEF SUMMARY

In an embodiment, a vermin-resistant bocce court is provided that includes a concrete slab layer including an integrated drainage system with drain inlets, a modular suspended surface layer disposed over the concrete slab layer, a filter fabric layer disposed over the modular suspended surface layer, and a surface layer disposed over the filter fabric layer, wherein the drainage system is configured to drain water collected in the modular suspended surface layer to a location external to the bocce court.

In another embodiment, a method of manufacturing a bocce court is provided. The method may include providing a concrete slab layer, disposing a modular suspended surface layer over the concrete slab layer, disposing a filter fabric layer over the modular suspended surface layer, disposing a surface layer over the filter fabric layer, and providing a drainage system proximal to or within the concrete slab layer, the drainage system being configured to drain water collected in the modular suspended surface to a location external to the bocce court.

In certain aspects, the surface layer includes sand and/or oyster flour and/or crushed seashells and/or decomposed granite and/or a synthetic turf or other synthetic product which forms a finished surface for playing bocce.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

BRIEF DESCRIPTION OF THE SEVERAL VIEWS OF THE DRAWING(S)

FIG. 1 is a cross-sectional diagram of a vermin-resistant low-maintenance bocce court in accordance with an embodiment.

DETAILED DESCRIPTION

The present disclosure provides a vermin-resistant low-maintenance bocce court and a method of manufacturing the same.

As shown in FIG. 1 an embodiment of a bocce court 10 includes a base concrete layer 1 with an integrated drainage system , and a water collection layer 3, including for example a suspended modular surface, over the concrete slab layer 1 and inlets to integrated drainage system including one or more pipes or passages 6 through the concrete slab layer 1, optionally including horizontal drain pipes 7 (e.g., perforated drain line) to facilitate flow of drainage water to external the court structure. A filter fabric layer 4 overlays the water collection layer 3 and a surface layer 5 that comprises the playing surface overlays the filter fabric layer. The surface layer 5 may include a layer of a particulate material distributed over the filter fabric layer 4. The particulate matter may include crushed seashells or other particulate matter appropriate for playing bocce.

The surface layer 3 may include, for example, crushed oyster shells and oyster flour, with optional addition of sand and/or EPDM particles to adjust ball roll speed, which is applied over the filter fabric layer 4, vibrated, and compacted.

The bocce court 10 can optionally be supported by compacted base rock layer 2 (e.g., about 4" class 2 base rock and/or ½"-1" decomposed granite). A perimeter curb 8 (e.g., concrete) can be installed and, optionally, bumper boards 9 (e.g., wood). Weep holes can be provided in the perimeter curb 8 to drain water atop the concrete slab layer 1 around the periphery of the court surface, and a drainage system 6, 7 (e.g., perforated drain line) can, optionally, be installed beneath the base rock 2.

The water collection layer 3 allows water to move through the surface layer 5 and filter fabric layer 4 and accumulate on the concrete slab layer 1 until a positive flow is established and the water flows through the integrated drainage system to outside the bocce court and/or into infiltration columns. The water collection layer 3 preferably includes a suspended surface layer made of a plurality of modular interconnecting tiles that provide a "porosity" to water so that water can collect within the suspended surface layer atop the concrete slab layer, but below the surface layer, and drain to external the court, e.g., via the integrated drainage system and/or weep holes on the periphery of the court. For example, the suspended surface layer may comprise a porous material such as a porous plastic material. The suspended surface layer preferably has a substantially uniform thickness of at least ½" to allow for water to collect and drain without affecting the playing surface. The thickness may be as large as a few or several inches.

The bocce court has a drainage system 6, 7 for removing water from the surface of the court and/or the ground beneath the court. The drainage system may include weep holes (not shown) or other portals or openings in the curb 8 surrounding the court through which water can escape. Alternatively or additionally, the drainage system may include one or multiple vertical pipes or passages extending through the concrete slab layer so that water collecting atop the concrete slab layer may flow into drain inlets connected to the pipes or passages and flow to a location external to the court. Alternatively, or additionally, the drainage system may include one or multiple weep holes around a periphery of the water collection layer, e.g., modular suspended surface layer, so that water collecting atop the concrete slab layer may weep out external to the court.

The filter fabric layer 4 may include a monofilament material or a multifilament material, such as a mesh fabric including one or more materials. Examples include polypropylene, polyester, polyamide, polyethylene, polyolefin, polyvinylidene-chloride, or any other material which allows water to pass through without allowing the top surface materials (e.g., surface layer materials) to pass through.

In an embodiment, a compacted base layer 2 such as decomposed granite, rocks, etc, underlies the concrete slab layer to provide additional support, especially for unstable ground environments. In this embodiment, any pipes or passages forming the drainage system may optionally pass through the compacted base layer.

A surface layer 5 comprising a surface material such as crushed seashells is applied over the filter fabric layer. The surface layer 5 can be, for instance, a layer of oyster flour of the type used for bocce ball courts. Oyster flour and other crushed seashell based materials are commercially available. In some embodiments, the surface layer comprises about 50% or more (e.g., about 75% or more, about 85% or more, or about 90% or more) oyster flour. The surface layer can further comprise sand and/or polymer particles (e.g., EPDM particles) to adjust ball roll speed as desired. In general, the surface layer may include sand and/or oyster flour and/or crushed seashells and/or decomposed granite and/or a synthetic turf or other synthetic product which forms a finished surface for playing bocce.

In an embodiment, the surface layer 5 may include a surface system such as is disclosed in U.S. Pat. No. 9,539,490 or U.S. Pat. No. 9,174,112, which are both incorporated herein by reference. When used with the surface system of the '490 patent, for example, the bocce court provides a low bounce surface desirable for the sort of bocce.

The court surface desirably provides a ball rebound of about 20% or less (e.g., about 15% or less or even about 10% or less) than the ball rebound of a concrete surface. Ball rebound, for the purposes discussed herein is determined by dividing the height of the rebound of a plastic resin bocce ball with a diameter of 107 mm and weight of 920 g dropped on the bonding layer and force reduction layer laid over a concrete slab by the height of the rebound of the same bocce ball dropped from the same height directly on a concrete slab.

The bocce court typically has a substantially rectangular shape with a width and length suitable for bocce play. Generally, the bocce court will have a width of about 8 feet to about 13 feet and a length of about 60 feet to about 91 feet.

The bocce court can comprise a curb 8 around the perimeter of the rectangular shaped court with a height above the court surface sufficient to retain bocce balls inside the court perimeter. Typically, the curb 8 extends above the surface of the court by about 4 inches to about 12 inches. The bocce court may also have bumpers along a portion of the curb that provides the sidewalls of the court (along the lengthwise/longest dimension of the court). The bumpers may be made of a material that provides suitable rebound for bocce play (e.g., natural or synthetic wood, rubber, or plastic (polymer) material of suitable hardness). The bocce court also may have a backboard at one end of the court, perpendicular to the sides of the court, of a material suitable to reduce rebound of a bocce ball striking the backboard (e.g., natural or synthetic wood, rubber, or plastic (polymer) material of suitable hardness).

The bocce court surface positioned over the concrete slab layer with integrated drainage system provides a rolling resistance appropriate for traditional bocce play. Rolling resistance can be measured using a stimpmeter, which is a ramp with a 145° V-shaped groove extending along its length and set to the ground at a given angle. A ball released from a given height on the ramp is allowed to roll onto the bocce court surface and the distance that the ball rolls away from the ramp reflects the rolling resistance of the surface. The measurement is repeated until three measurements within 8" of each other are obtained, and an average of the three measurements is used. According to one embodiment, the court surface has a stimpmeter rolling distance of about 15-25 feet, such as about 7-12 feet, when measured using a plastic resin bocce ball with a diameter of 107 mm and weight of 920 g and a stimpmeter with an incline of 35° from a level surface and a release height of 9 inches.

Other materials and components typically used in the installation of a bocce court can also be used in accordance with the present embodiments. For instance, a leveling compound may be used over the concrete slab to achieve a level surface as needed. Also, adhesives may be used to adhere any of the various layers to an adjacent layer.

The bocce court can be manufactured by any suitable method. In one embodiment, for example, the bocce court can be prepared by (a) providing a concrete slab layer, (b) disposing a modular suspended surface layer over the concrete slab layer, and (c) disposing a filter fabric layer over the modular suspended surface layer. In certain embodiments, the concrete slab layer is provided with a drainage system proximal to or within the concrete slab layer, the drainage system being configured to drain water collected in the modular suspended surface layer to a location external to the bocce court. The method can further include disposing a surface layer over the filter fabric layer, wherein the surface layer comprises the playing surface. The surface layer may include sand and/or oyster flour and/or crushed seashells and/or decomposed granite and/or a synthetic turf or other synthetic product which forms a finished surface for playing bocce.

Additionally, the surface layer can be applied by any suitable method. For instance, the surface layer material can be distributed evenly over the filter fabric layer, and the surface layer can be tamped, rolled, vibrated, and/or raked, to provide a level playing surface with the desired amount of compaction.

In an embodiment, the surface layer may include an surface layer system such as described in U.S. Pat. No. 9,539,490.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A bocce court, comprising:

a concrete slab layer including a drainage system with drain inlets;

a modular suspended surface layer disposed over the concrete slab layer;

a filter fabric layer disposed over the modular suspended surface layer; and a surface layer disposed over the filter fabric layer;

wherein the drainage system includes a plurality of vertical pipes extending through the concrete slab layer, and wherein the drainage system is configured to drain water collected in the modular suspended surface layer to a location external to the bocce court.

2. The bocce court of claim 1, further comprising a compacted base layer disposed under the concrete slab layer.

3. The bocce court of claim 1, wherein the plurality of vertical pipes are connected to one or more horizontal pipes.

4. The bocce court of claim 1, wherein the drainage system includes a plurality of weep holes around a periphery of the modular suspended surface layer.

5. The bocce court of claim 1, wherein the concrete slab layer includes steel reinforced concrete.

6. The bocce court of claim 1, wherein the modular suspended surface layer comprises a porous plastic material.

7. The bocce court of claim 6, wherein the modular suspended surface layer comprises a plurality of interlocking tiles.

8. The bocce court of claim 1, wherein the modular suspended surface layer has a substantially uniform thickness of at least ½".

9. The bocce court of claim 1, wherein the modular suspended surface layer comprises a plurality of modular interlocking tiles.

10. The bocce court of claim 1, wherein the surface layer comprises sand and/or oyster flour and/or crushed seashells and/or decomposed granite and/or a synthetic turf or other synthetic product which forms a finished surface for playing bocce.

11. The bocce court of claim 1, wherein the filter fabric layer comprises a mesh fabric comprising one or more materials selected from the group consisting of polypropylene, polyester, polyamide, polyethylene, polyolefin, polyvinylidene-chloride, or any other material which allows water to pass through it without allowing the top surface materials to pass through it.

12. The bocce court of claim 1, wherein the filter fabric layer comprises a monofilament or a multifilament material.

13. A method of manufacturing a bocce court, the method comprising:

providing a concrete slab layer;

disposing a modular suspended surface layer over the concrete slab layer;

disposing a filter fabric layer over the modular suspended surface layer;

disposing a surface layer over the filter fabric layer; and providing a drainage system proximal to or within the concrete slab layer, wherein the drainage system includes a plurality of vertical pipes extending through the concrete slab layer, and wherein the drainage system is configured to drain water collected in the modular suspended surface layer to a location external to the bocce court.

14. The method of claim 13, wherein the plurality of vertical pipes are connected to one or more horizontal pipes.

15. The method of claim 13, wherein the drainage system includes a plurality of weep holes around a periphery of the modular suspended surface layer.

16. The method of claim 13, wherein the modular suspended surface layer comprises a plurality of interlocking tiles.

17. The method of claim 13, wherein the surface layer comprises sand and/or oyster flour and/or crushed seashells and/or decomposed granite and/or a synthetic turf or other synthetic product which forms a finished surface for playing bocce.

18. The method of claim 13, wherein the filter fabric layer comprises a mesh fabric comprising one or more materials selected from the group consisting of polypropylene, polyester, polyamide, polyethylene, polyolefin, polyvinylidene-chloride, or any other material which allows water to pass through it without allowing the top surface materials to pass through it.

19. A bocce court, comprising:

a concrete slab layer including an integrated drainage system with drain inlets;

a modular suspended surface layer disposed over the concrete slab layer, wherein the modular suspended surface layer comprises a porous plastic material;

a filter fabric layer disposed over the modular suspended surface layer; and a surface layer disposed over the filter fabric layer;

wherein the integrated drainage system is configured to drain water collected in the modular suspended surface layer to a location external to the bocce court.

20. The bocce court of claim 19, wherein the modular suspended surface layer comprises a plurality of interlocking tiles.

* * * * *